US007931164B2

(12) United States Patent
Krohn

(10) Patent No.: US 7,931,164 B2
(45) Date of Patent: Apr. 26, 2011

(54) FOLDABLE PORTABLE CONTAINER

(76) Inventor: Christopher G. Krohn, Knoxville, TN (US)

( * ) Notice: Subject to any disclaimer, the term of this patent is extended or adjusted under 35 U.S.C. 154(b) by 513 days.

(21) Appl. No.: 12/220,924

(22) Filed: Jul. 30, 2008

(65) Prior Publication Data

US 2010/0025398 A1 Feb. 4, 2010

(51) Int. Cl.

| | |
|---|---|
| ***B65D 88/00*** | (2006.01) |
| ***B65D 6/00*** | (2006.01) |
| ***B65D 8/14*** | (2006.01) |
| ***B65D 8/04*** | (2006.01) |

(52) U.S. Cl. ..... 220/7; 220/1.5; 220/6; 220/666; 52/64; 52/66; 52/79.5

(58) Field of Classification Search ..... 220/1.5, 220/6, 666; 52/64, 66, 79.5, 143
See application file for complete search history.

(56) References Cited

U.S. PATENT DOCUMENTS

| | | | | |
|---|---|---|---|---|
| 844,955 | A * | 2/1907 | Morgan | 220/8 |
| 4,577,772 | A * | 3/1986 | Bigliardi | 220/1.5 |
| 4,684,034 | A * | 8/1987 | Ono et al. | 220/6 |
| 2007/0108204 | A1 | 5/2007 | Warhurst et al. | |

* cited by examiner

*Primary Examiner* — Anthony Stashick
*Assistant Examiner* — Madison L Wright

(57) ABSTRACT

A foldable portable container is described. The container end walls are hinged to the floor of the container and are attached to the roof by a hinged slide mechanism whereby vertical displacement of the roof causes the simultaneous folding or unfolding of the opposing container end walls.

9 Claims, 5 Drawing Sheets

FOLDABLE PORTABLE CONTAINER

BACKGROUND OF THE INVENTION

1. The Technical Field

The present invention is directed generally to portable containers useful for the shipping and/or storage of goods and materials and for field housing applications, and more particularly to an improved foldable portable container.

2. The Prior Art

The efficiency and costs associated with the moving, shipping and/or storage of various goods and materials has been greatly improved through the use portable containers that can be easily transported to different locations by a suitable carrier such as a truck or ship. These containers are provided in a wide size range varying from relatively small volume containers that are particularly suitable for storage and moving applications to larger volume containers suitable for the transport of goods and materials by rail or ship.

One drawback found to be present with previously known portable containers is that these containers, empty or filled, require the same space for transportation and storage purposes. This problem has been addressed by utilizing foldable containers which can be shipped and stored and then unfolded for receiving storable goods and subsequent storage or shipping and storage of the loaded containers. Such a foldable container which when folded occupies a significantly smaller volume than when in an unfolded state has been provided by Peter S. Warhurst et al as shown and described in United States Patent Application Publication, No. US2007/0108204 A1, published May 17, 2007. Another such foldable container is described by Ono et al in U.S. Pat. No. 4,684,034, issued Aug. 4, 1987. Both the publication and the patent are directed to a foldable portable container having foldable end walls pivotally attached to the container floor or to the roof and sidewalls that are folded in the middle and are pivotally attached to both the roof and the floor. The end walls are pivotally folded flat and then the side walls are folded inwardly, accordion style, along with the attached roof to provide a folded container of a significantly reduced volume. The empty containers are unfolded for use in the envisioned application by reversing the folding operation. Inasmuch as the side walls and the attached roof are cumbersome and relatively heavy for manually handling a lifting mechanism such as provided by a fork lift or crane is used to support the roof during both the container folding and unfolding operations.

SUMMARY OF THE INVENTION

The present invention is directed to an improved foldable portable container useful for the storage and/or shipping of goods and materials as well as such containers configured to provide field applications such as housing or medical use. Generally, the foldable container of the present invention comprises elongated base means and roof means oriented in planes substantially parallel to and vertically spaced from one another. First and second elongated opposing and vertically oriented side wall means are disposed between the base means and the roof means. First and second elongated vertically oriented and opposing end wall means are disposed between the base means and the roof means and are oriented in vertical planes substantially normal to the first and second side wall means. Hinge means connect an end section of each of the first and the second side wall means to the base means for the pivotable displacement of the each side wall means towards the base means and into locations adjacent to and overlying the base means. Further hinge means connect an end section of each of the first and second end wall means to the base means for providing rotational axes for the angular displacement of the first and second end wall means in first opposing direction towards one another during container folding. Elongate slide means are attached to the roof means and disposed between the first and second end wall means and support movable hinge means that are connected to an upper surface region of each of the first and second end wall means. The movable hinge means are displaceable along the slide means for the simultaneous displacement of the first and second end wall means and the connected roof means in the first opposing directions towards the base means and into substantially parallel locations overlying and adjacent to the first and second side wall means and in second opposing directions opposite to the first opposing directions for the simultaneous displacement of the first and second end wall means away from the substantially parallel location overlying the base means for positioning the first and second end wall means in the vertical orientation with the roof means in the plane vertically spaced from the base means.

The roof means has framework means disposed at peripheral edge regions thereof and includes side sections substantially overlying and inwardly spaced from upper end regions of the first and second side wall means. The elongate slide means comprise an elongated substantially u-shaped open-sided channel member attached to each of the side sections of the framework means and extending substantially between the first and second end wall means. The movable hinge means are disposed within the u-shaped channel member where reentrant wall portions at the opening thereinto support and provide a bearing surface for the movable hinge means. Also, the further hinge means connecting the end region of each of the first and second portions of the frame means to the base means include slidable means for the vertical displacement of the first and second end wall means relative to the end regions of the base means during the displacement of the first and second end wall means in the first direction. This vertical displacement of the first and second end wall mean positions distal end regions of the frame means contiguous to the further hinge means at locations substantially underlying peripheral edge regions of roof means when the first and second end wall means are in the substantially parallel locations.

By utilizing this combination of features portable containers can be readily transported to the desired point of use in a folded state then unfolded to form structurally sound containers suitable for the intended use. Also, empty unfolded containers located at various locations including highly remote sites may be readily collapsed or folded into a relatively small shipping package by reversing the container folding operation. Of significance in the improvement in the present invention is that the folding and unfolding of the portable containers is achieved by attaching movable hinge means to both end walls of the container an to the elongated slide means fastened to the roof. The movable hinge means are then moved or displaced along the slide means in first opposing directions by lowering the roof to fold the container and by raising the roof to displace the movable hinge means along the slides in opposing directions opposite to the first opposing directions to unfold the container. The lowering or raising the roof to effect the folding or unfolding of the container is achieved by using an external lifting mechanism such as a hoist, fork lift or a crane.

Other and further features of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

Figure 1:
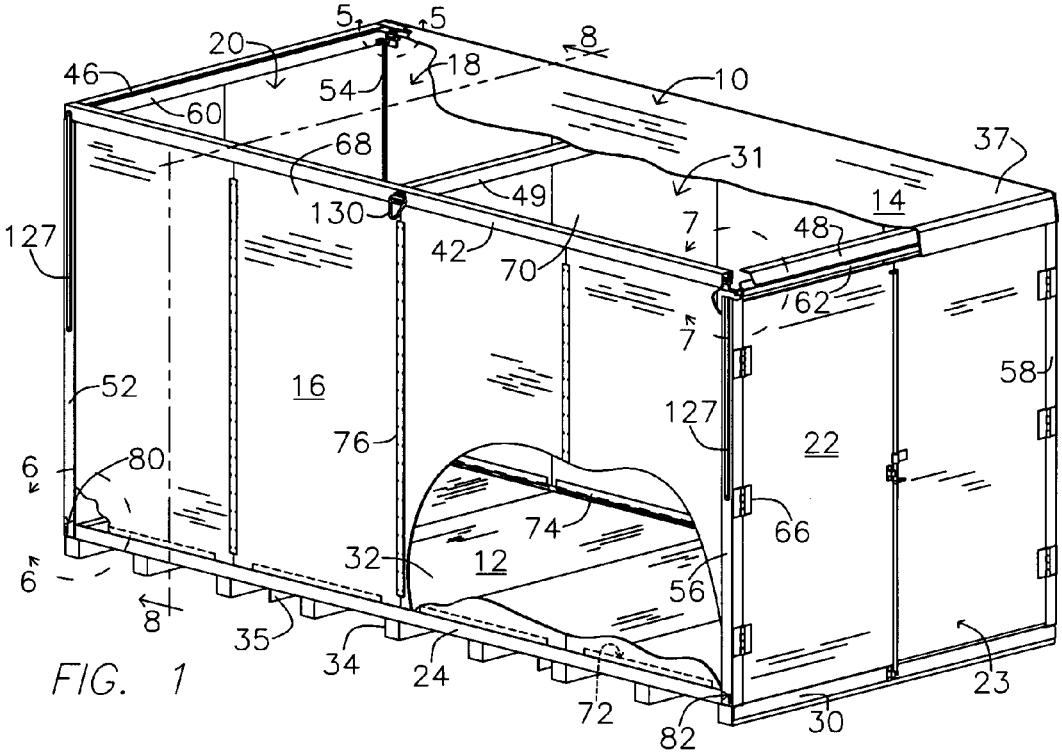
FIG. 1 is a perspective view of a preferred embodiment of the foldable container of the present invention with portions of the container broken away for illustrating details of the slide and hinging mechanism utilized for folding and unfolding the container.
Figure 10:
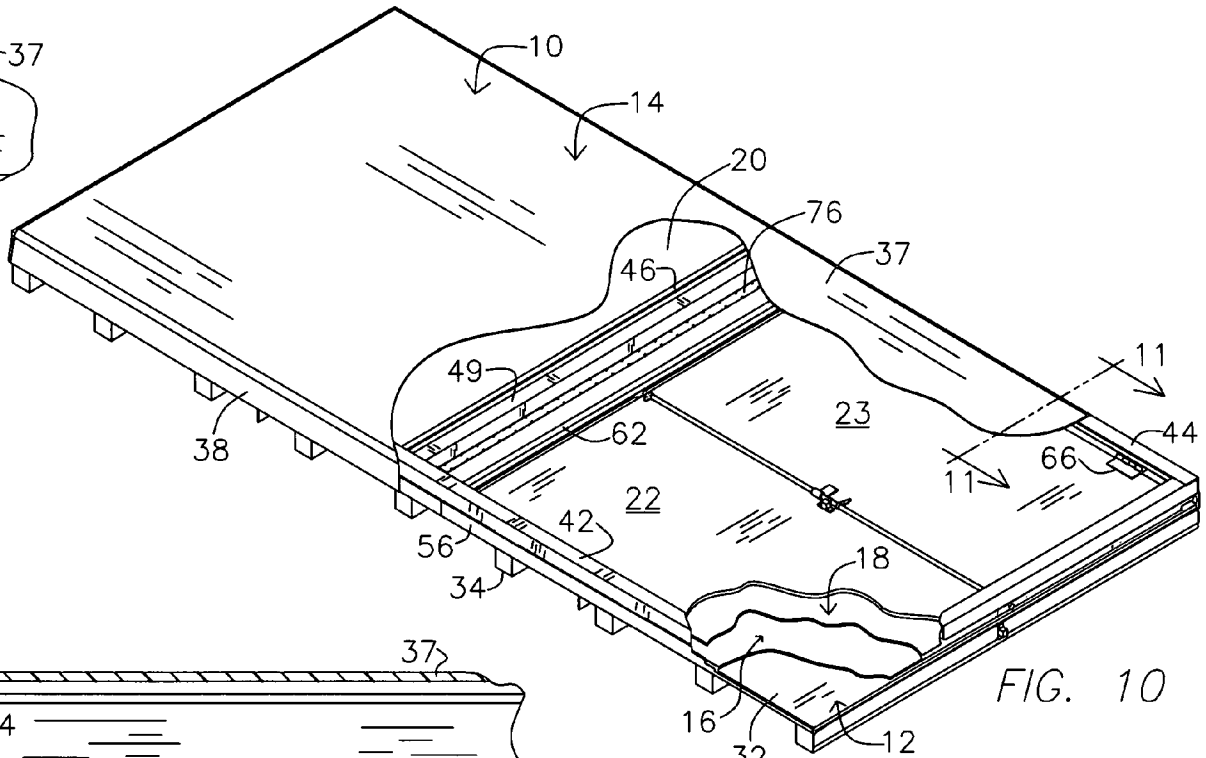
FIG. 10 is a perspective view of the container of FIG. 1 showing the container fully folded.

A preferred embodiment of the foldable portable container 10 is shown FIG. 1 in an assembled or unfolded state suitable for providing an enclosable space or volume satisfactory for the storage of goods and materials and the transportation of such contained goods and materials. The container 10 is of a rectangular configuration and of any dimension desired for the particular intended purpose and which is suitable for transportation by a common carrier such as truck, rail, air or ship. For example, a container with unfolded dimensions of 8'×8'×16' is of a sufficient size suitable for such shipment and for use in most storage and transportation applications as well as for other uses such as field applications requiring a readily portable and erectable contained space for living quarters, field offices, laboratories or field medical facilities. In the present invention the length of the container is at least substantially twice the height of the contained volume so as to assure the top ends of the folded end walls will be contiguous to one another when the container is folded as shown in FIG. 10.

As shown in FIGS. 1-4, the container 10 is generally defined by a horizontally extending rectangular floor 12, a horizontally extending rectangular roof 14 which is positioned in a plane parallel to and vertically separated from the floor 12. This positional relationship of the floor and roof is provided by vertically extending and horizontally spaced-apart side walls 16 and 18 and vertically extending and horizontally-spaced-apart end walls 20 and 22. End wall 22 is shown with a lockable double door assembly 23 for controlled access into the container 10.

More specifically, the floor 12 of the container 10 has a rectangular frame formed of elongated angle-iron railings 24, 26, 28 and 30 (FIG. 2) that are preferably joined together at the ends thereof in any suitable manner such as by welding. The floor railings 24 and 26 are positioned on opposite sides of the floor 12 with upwardly extending flanges positioned adjacent to outermost edges of the floor 12. The floor railing 28 at the end of the container 10 opposite the door 23 is similarly positioned but with the upwardly extending flange being slightly inset from the edge of the floor 12, the purpose of which will be explained below. The angle-iron railing 30 at the door end of the container 10 is positioned with one flange extending downwardly at outer edge of the floor 12 to provide easy ingress and egress into and from the contained volume 31 of the container 10.

The floor 12 includes a deck 32 formed of side-by-side panels of wood or any other suitable material. These floor panels are supported at the ends thereof on the horizontally inwardly extending flanges of by the angle-iron railings 24, 26, 28 and 30. The deck panels may be attached to these angle-iron flanges in any suitable manner such a by screws, bolts or the like. The floor 12 is shown supported by plurality of horizontally spaced-apart wooden beams 34 underlying deck and the angle-iron railings. The floor 12 can also be provided with additional structural support such as provided by metal cross members 35 positioned between the wooden beams 34.

Figure 11:
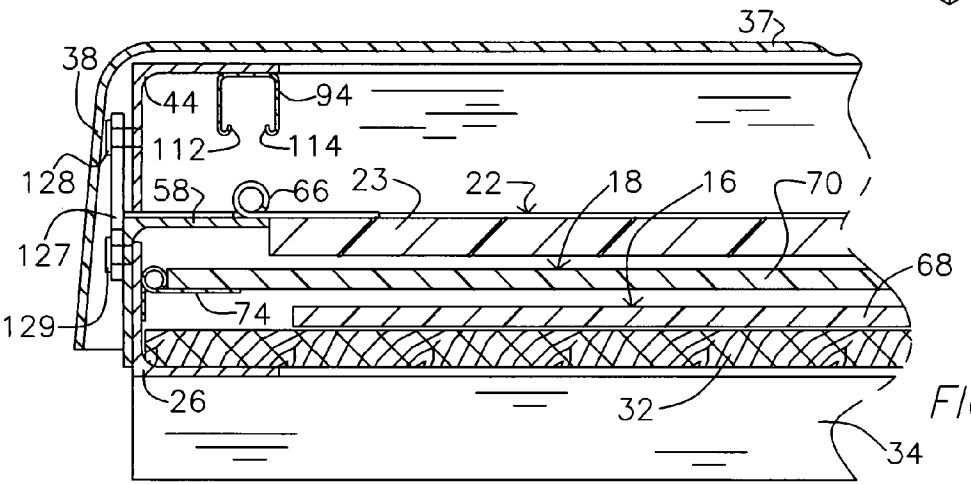
FIG. 11 is a fragmentary sectional view taken along lines 11-11 of FIG. 10 showing the positional relationship of container components when the container is in a folded state.

The roof 14 of the container 10 is provided by a rectangular top or cap 37 formed of any suitable material such sheet metal, fiberglass or of a thermoformed plastic. The roof cap 37 is preferably provided with downwardly extending side regions or eaves 38 which are shown disposed at an outwardly projecting angle with respect to the vertical plane. Thus, when the container 10 is in a folded state as shown in FIGS. 10 and 11 the eaves 38 overhang and cover the underlying container components. In the present invention the roof cap 37 is provided with a rectangular framework 40 that is positioned under the cap adjacent to the eaves 38. The framework 40 is shown formed of elongated angle-iron sections 42, 44, 46 and 48 which are attached together at the ends thereof by welding or the like and to the roof cap 37 by any suitable means such as screws or bolts (not shown). These angle-iron sections are positioned so that the upper surface regions of the roof framework 40 is defined by horizontally inwardly facing or extending flange portions of the angle iron sections while the peripheral edge regions of the framework 40 is defined by the vertically downwardly extending flange portions of the angle iron sections. The roof framework 40 also includes a centrally positioned angle iron brace 49 which extends between the side wall sections 42 and 44 for providing additional structural support for the cap 37. The structural integrity of the roof 14 may be further enhanced by providing the roof cap 37 with a strength increasing array of ribs or other reinforcing shapes formed during or subsequent to the construction thereof.

Figure 2:
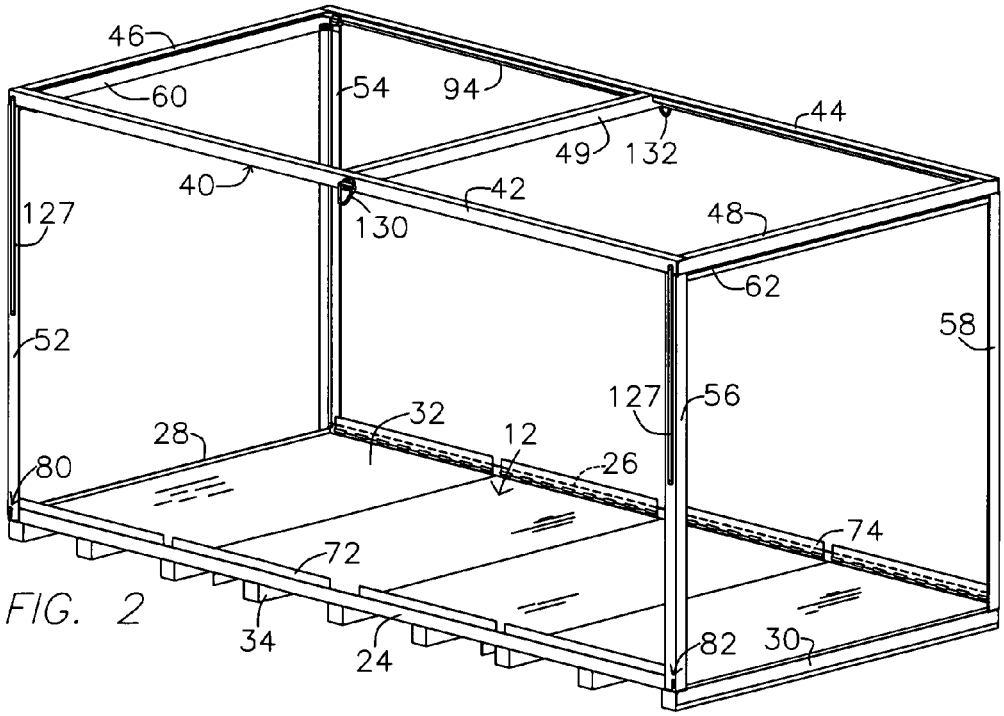
FIG. 2 is a skeletal perspective view of FIG. 1 illustrating the container framework.

The roof 14 is supported by four angle iron columns 52, 54, 56 and 58 that are positioned at the corners of the container 10 and vertically extend between the floor railings 24, 26, 28, and 30 and the angle iron sections 42, 44, 46 and 48 of the roof framework 40. The vertical columns can be of any length depending on the interior height desired of the container and are of a sufficient dimension and thickness needed to provide the container with the structural integrity required for the envisioned uses of the container 10. These columns 52, 54, 56 and 58 are each positioned so that the apex connecting the right angle flanges of these angle iron columns defines the vertical corners of the container 10. The flanges of each of these vertical columns project towards the vertical flanges of adjacent columns as best shown in FIG. 2. Metal crossbars 60 and 62 in the form of rectangular plates are horizontally positioned and extend between the upper ends of the facing flanges of columns 52 and 54 and columns 56 and 58 respectively. These cross bars 60 and 62 are securely connected at the ends thereof to the flanges of the columns at the uppermost ends thereof by welding, bolting or any other suitable fastening means like. These cross bars 60 and 62 are connected to and so positioned on the columns so that the opposite end or surface regions thereof will nest within the uppermost end regions of the column flanges and be positioned adjacent to the inside surface of the vertically projecting flanges of roof framework sections 46 and 48.

The angle iron used in the columns, the floor railings and the roof framework with dimensions of 3"×3"×3/16" is believed to sufficient to provide a container 10 of the aforementioned exemplary dimensions with adequate structural strength use in envisioned applications. However, the dimensions of the angle iron used for these members can be readily changed to any desired dimension or combination of dimensions without departing from the spirit and scope of the present invention. The angle iron used for the floor railing 28 is preferably 3"×2"×3/16" with the vertically extending flange of railing 28 being 2" in height for reasons explained below. The vertical columns and the attached cross bars form the framework of the end walls 20 and 22. The end wall 20 is completed by placing one or more panels 64 on the framework defined by flanges of columns 52 and 54 and the lower end region of cross bar 60 and affixing these panels 64 to this framework in any suitable manner such as by employing easily removable cam locks, screws, latches or the like. End wall 22 is completed by attaching the side panels of the double door 23 to the flanges of columns 56 and 58 with suitable hinges such as the butt hinges shown at 66 in FIGS. 2, 3, 4, and 11.

Figure 3:
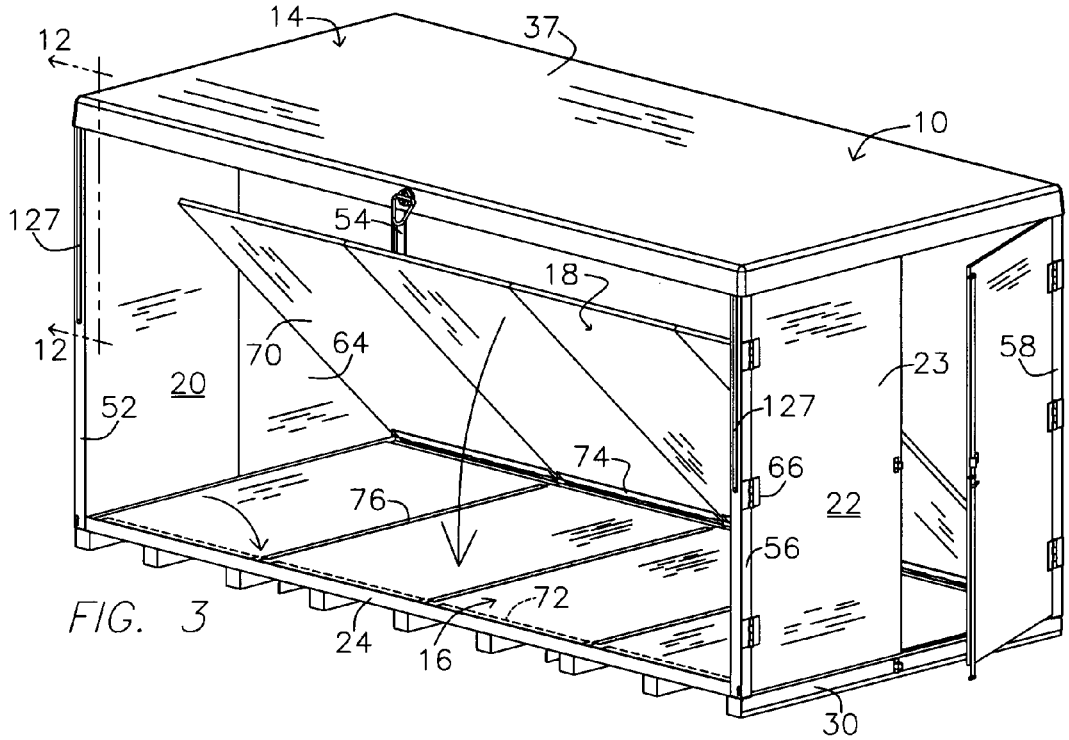
FIG. 3 is a perspective view of the FIG. 1 embodiment showing the container in a partially folded state.
Figure 4:
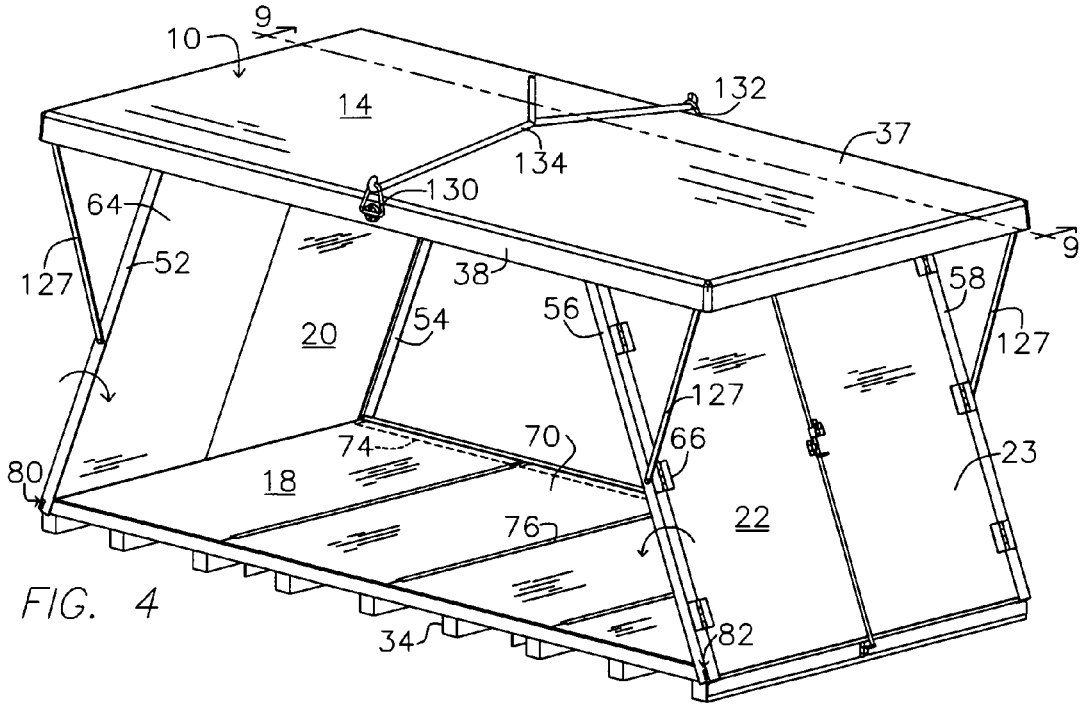
FIG. 4 is a perspective view of the FIG. 1 embodiment illustrating a further stage of container folding wherein the container end walls with the attached roof are being simultaneously folded.
Figure 12:
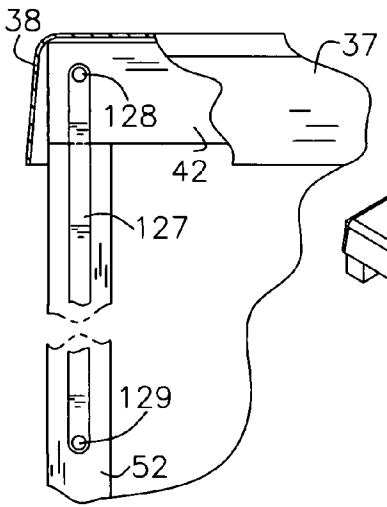
FIG. 12 is a fragmentary sectional view taken along lines 12-12 of FIG. 3 showing details of one of the four elongated stabilizing arm assemblies used for maintaining the roof assembly in a plane parallel to the container base during vertical displacements thereof.

In the present invention the side walls 16 and 18 can be formed of one or more rectangular or square wall panels 68 and 70 (four such side wall panels are shown FIGS. 1, 3 and 12 for each side wall 16 and 18). These side wall panels 68 and 70 may be formed of any suitable material such as wood, plastic, metal, composite materials or any combination thereof. When using a multiple number of panels to form the side walls 16 and 18, the panels can be connected together by employing any suitable fastening mechanism such as screws, or screw-on strips as generally shown at 76, clamps or any other connecting mechanism which provides a secure connection. Preferably, the connecting mechanism for connecting the panels together are of the type which can be readily attached or removed in order to facilitate changing the panel arrangement as would be desired for containers having modular capabilities such as the windows and various door arrangements such as a single door.

These wall panels 68 and 70 are placed in a side-by-side relationship and are attached to the inside surface of the vertical flanges of side floor railings 24 and 26 by hinge means 72 and 74. These side wall panels are also positioned on the inside surface of the vertical flange of the roof framework sections 42 and 44. The tops and the open end portions of these joined-together side wall panels are also securely fastened to the inside of vertical flanges of the roof framework sections 42 and 44 and the inside of the side-facing flanges of the vertical columns 52, 54, 56, and 58 by secure but readily removable connecting means such as cam locks, spring-loaded clips, latches or screws as generally shown at 78 in FIG. 8. The secure fastening of the side-wall panels to the flanges on the roof framework and on the vertical columns increases the structural integrity of the container and helps assure weather tightness of the container. Suitable weather stripping is preferably used between joints of the side-wall and end wall components as well as in any other joint area of the container where the use of weather stripping would be desirable to provide a weather tight structure.

Figure 8:
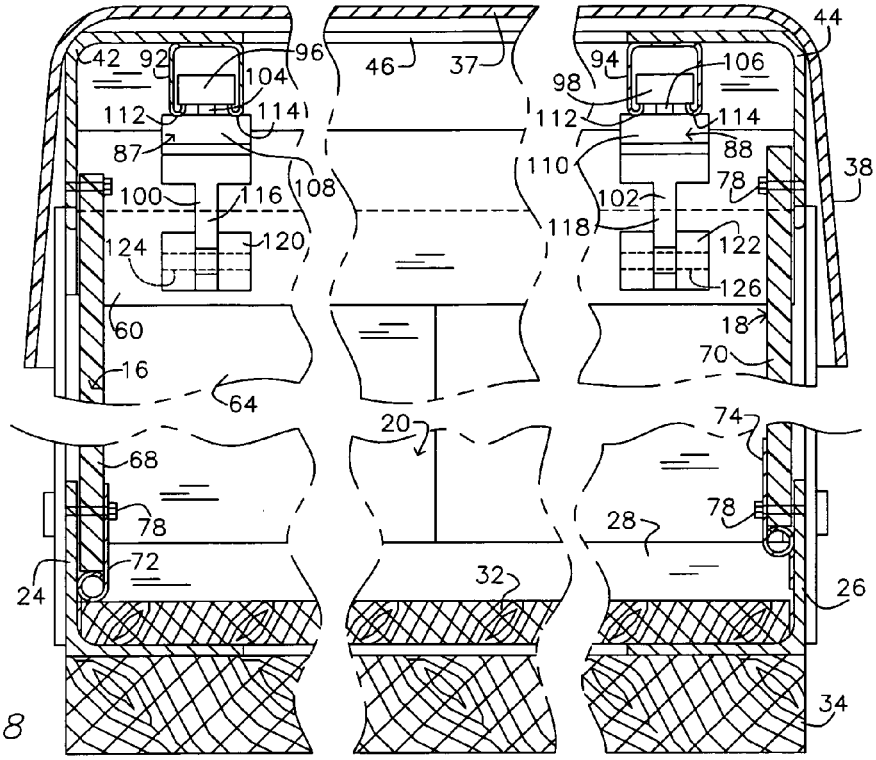
FIG. 8 is transverse vertical cross-sectional elevational view taken along line 8-8 of FIG. 1 showing further details of the folding and unfolding mechanism and the container sidewalls.

The hinges 72 and 74 connecting the side-wall panels 68 and 70 to the upright flanges of the side floor railings 24 and 26 are of any suitable type which is of sufficient strength to maintain the panels in the selected position and which will provide an axis of rotation or pivot axis for the panels. Piano hinges, as shown, are satisfactory for this purpose but other types of hinges such as butt hinges or slip joint hinges may be used. As shown in FIGS. 8, 10 and 11, the hinge 74 is positioned on the flange of the floor railing 26 at location higher than the position of hinge 72 on the flange of floor railing 24 so that the side walls 16 and 18 can be sequentially folded into a parallel stack on the deck 32 of the container floor 12.

Figure 9:
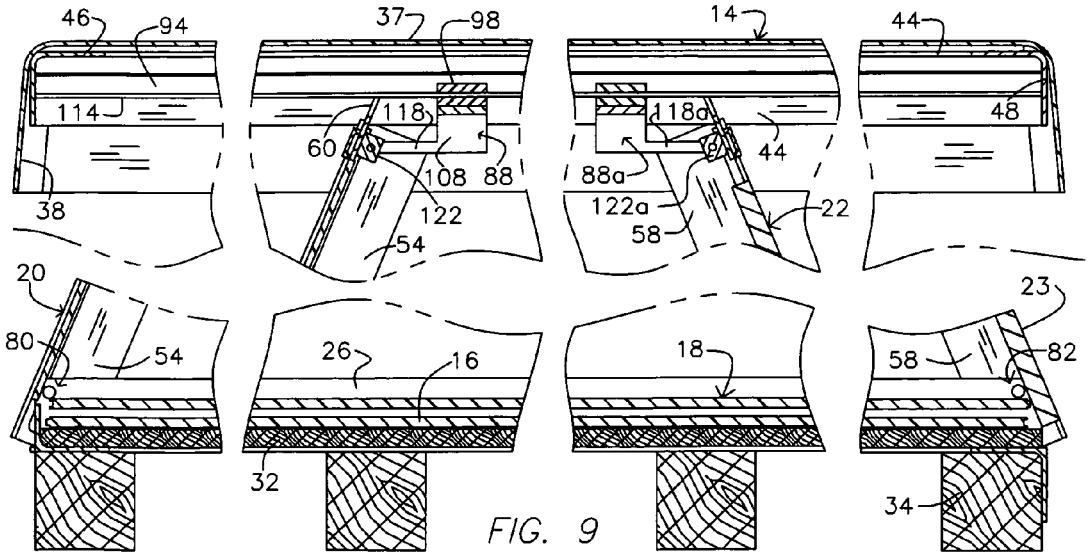
FIG. 9 is an elevational view generally taken along line 9-9 of FIG. 4, partially broken away, showing details of the folding and unfolding mechanism and the position of such with the container in a partially folded state.

For the purpose of folding the side walls 16 and 18 into container 10, the fasteners 78 attaching the panels 68 and 70 to the vertical flanges on the roof framework and the flanges on the vertical columns are disengaged or removed and these panels are then manually folded in a sequential manner (panel 68 first and then panel 70) about the hinge couplings 72 and 74 into the stacked horizontal positions overlying the floor 12. These side wall panels 68 and 70 are shown partially folded in FIG. 3 and completely folded as shown in FIGS. 9, 10 and 11. When unfolding the side walls 16 and 18 of a folded container these folding steps are reversed.

In this embodiment of the invention the lower ends of the flanges on the vertical columns 52 and 54 are connected in a pivotable manner by hinge means 80 to the end portions of the adjacent vertical flanges of the side floor railings 24 and 26. Similarly, the lower ends of the flanges on the vertical columns 56 and 58 are connected in a pivotable manner by hinge means 82 to the end portions of the adjacent and inwardly facing vertical flanges at the door end of the side floor railings 24 and 26. These hinge means provide a rotational or pivot axis about which the joined together vertical columns 50 and 52 of end wall 20 and columns 54 and 56 of end wall 22 can be simultaneously pivoted or angularly displaced towards one another within the container 10 and into substantially horizontal end-to-end positions upon completely folding the container as shown in FIG. 10. Conversely, when the folded container is unfolded, the end walls 20 and 22 are pivoted about the rotational axes afforded by the hinge means 80 and 82 and angularly upwardly displaced away form the horizontal positions of FIG. 10 and into the upright positions required of the assembled container as in FIG. 1.

The lower end of the end wall 20 is positioned against the outside surface of the vertical flange floor railing 28 for enhancing the structural integrity of the unfolded container. For this purpose, the floor railing 28 is positioned sufficiently inwardly from the end of the floor so as to position the vertical flange of floor railing 28 inside of the end wall 20 a distance substantially corresponding to the thickness of the end wall 20.

Figure 6:
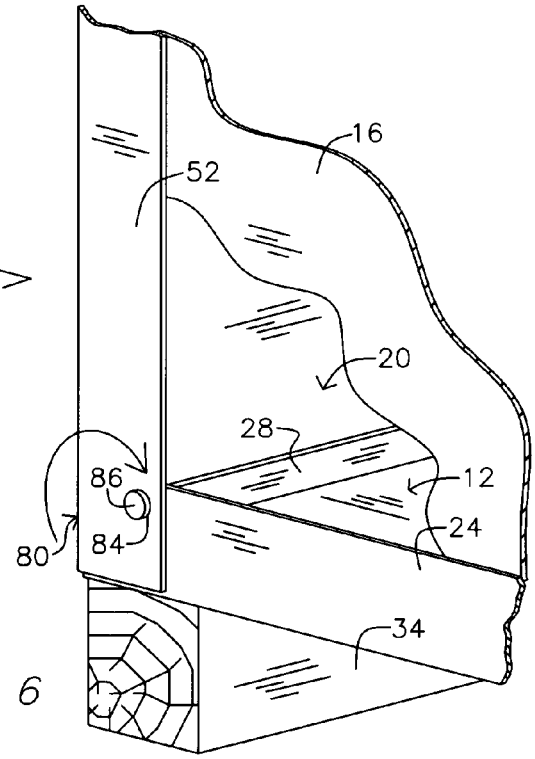
FIG. 6 is a fragmentary view taken along lines 6-6 of FIG. 1 showing details of the hinging arrangement used for the angular displacement of the container end walls.

A hinge mechanism about which end panels 20 and 22 can be satisfactorily pivoted as well as lifted in accordance with the requirements of the present invention is achieved by using a pin and bore arrangement as best illustrated in FIG. 6. This hinge arrangement is provided by placing a vertically extending through-going bore 84 in the lower end region of each side-facing flange on each of the four vertical columns 52, 54, 56 and 58. The end portions of the vertical flanges of the floor railings 24 and 26, are, in turn, each provided with a horizontally outwardly extending round pin 86 which is positioned within and extends through the bore 84 in the flange of an adjacent vertical column. When using this hinging arrangement the vertically extending flange on the floor railing 28 is of a height sufficiently less than the height of the vertical flanges on floor railings 24 and 26 so that the pins 86 projecting from the floor railings 24 and 26 can be positioned above and slightly inwardly from the top of the vertical flange on end floor railing 28.

The angular displacement of the end walls 20 and 22 provided by the hinging relationship of the pins 86 with the bores 84 assures that the end wall 20 will be pivoted over the top of the flange of floor railing 28 when this end wall 20 is folded into desired horizontal positions during the container folding operation and returned to the vertical abutting relationship with the flange on railing 28 when the container is unfolded. Also, the positions of the bores 84 in the column flange are such that the end walls 20 and 22 do not extend beyond the ends of the container floor 12 when the container folding operation is completed as shown in FIG. 10. This positioning of the end walls 20 and 22 assures that the eaves 38 on the roof cap 37 will overlap and cover the folded end walls as well as the folded side walls to provide a relatively weather tight and compact folded container package. While the preferred embodiment of foldable container 10 utilizes angle iron for the construction of the floor railings, the vertical columns and the roof framework, it will appear clear that aluminum may be used in place of the steel in these components and that at least some of these structural components can be in the form of rectangular tubing, open-sided channel iron, or any combination thereof including such combinations with angle iron.

In the foldable container 10 of the present invention the folding and unfolding of the end walls 20 and 22 simultaneously with the vertical displacement of the roof is achieved by utilizing movable connecting means 87 and 88 that join the cross bars 60 and 62 of the end walls 20 and 22 to the roof framework 40. The movable connecting means 87 and 88 are attached to both end walls and to the roof but are movable with respect to the roof 14 during the container folding and unfolding operations so as to vertically displace the attached roof 14 simultaneously with the folding and unfolding of the end walls 20 and 22. For the purpose of this description some of the components that are structurally and functionally similar to the described components will be have the same identifying numeral followed by the letter "a".

Figure 7:
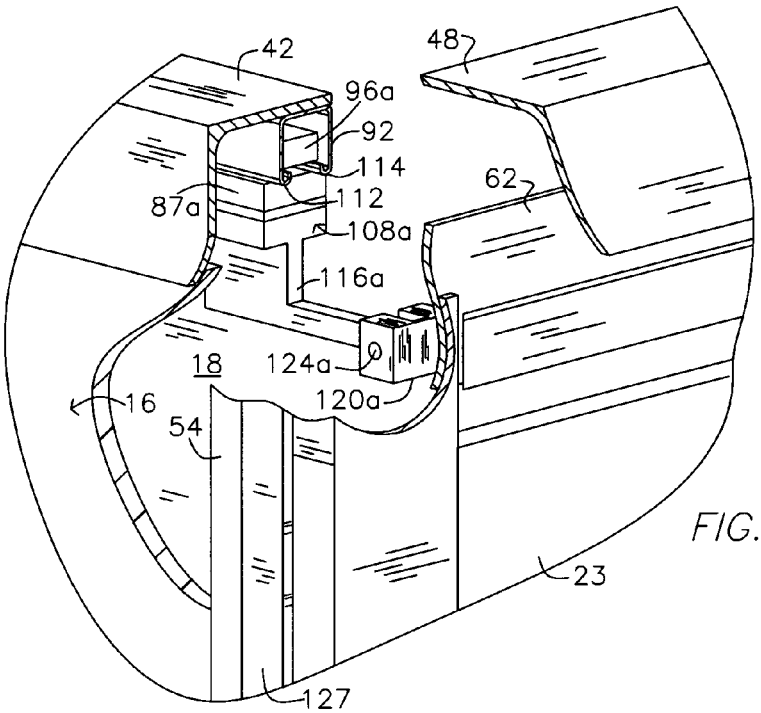
FIG. 7 is a fragmentary view taken along lines 7-7 of FIG. 1 showing further details of the movable hinge and slide arrangement utilized between the end walls and the roof of the container.
Figure 5:
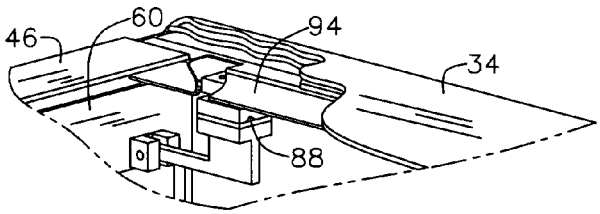
FIG. 5 is fragmentary view taken substantially along lines 5-5 of FIG. 1 and partially broken away for showing details of a movable hinge means of the container folding and unfolding mechanism.

Movable connecting means 87 and 88 found to be satisfactorily for this purpose comprise a plurality of movable hinge means (four are used in this embodiment of the invention) which are coupled to and slide along slide means provided by elongated U-shaped channel irons 92 and 94 that are securely connected by welding or the like to the horizontal flanges on the angle-iron side sections 42 and 44 of the roof framework 40. These channel irons 92 and 94 are placed so as to be parallel with one another and the sides of the container along the fold line for the end walls 20 and 22 and are of a length substantially corresponding to the spacing between the end walls 20 and 22 (FIG. 7). The opening into each of the channel irons 92 and 94 faces downwardly so as to respectfully receive therein round or rectangular end portions 96 and 98 of movable hinged slides 100 and 102. These end portions or slide support blocks 96 and 98 are joined by relatively thin neck regions 104 and 106 to further round or rectangular portions or slide support blocks 108 and 110 that are positioned outside of or below the U-shaped channel irons 92 and 94. As shown in FIGS. 7, 8 and 11 the openings into the channel irons 92 and 94 are provided with facing reentrant walls 112 and 114 which are at least substantially coextensive with the channel irons 92 and 94 and which are spaced from one another a distance sufficient to receive therebetween the neck portions 104 and 106 of the hinged slides 100 and 102.

With this arrangement the slide support block 96 and 98 of the hinged slides 100 and 102 are positioned within the channel irons 92 and 94 and rest upon the top surface of the reentrant walls 112 and 114. The rectangular slide support blocks 108 and 110 are maintained sufficiently close to the underside surfaces of the reentrant walls 112 and 114 to assure that the hinged slides will not tip or otherwise hang-up as the hinged slides 100 and 102 are moved along support guides provided by the elongated channel irons 92 and 94. The upper and the lower surface of the reentrant walls provide bearing surfaces for the slide support blocks 96, 98, 108 and 110. These slide support blocks can be formed of steel but are preferably formed of a polymeric material such as polypropylene, polytetrafluoroethylene or the like so as to reduce sliding friction as the hinged slides are moved along the channel iron slides 92 and 94 during the container folding and unfolding operations. Also, it will appear clear that rollers or the like can be used in place of the sliding blocks of the hinged slides 100 and 102.

The hinging action of the hinged slides 100 and 102 is achieved by attaching horizontally extending arms 116 and 118 projecting from the slide support blocks 108 and 110 of the hinged slides to the cross plates 60 and 62 of end walls 20 and 22 with a suitable hinge arrangement. Satisfactory hinging action can be achieved between the hinged slides 100 and 102 and the end wall cross plates 60 and 62 by using a simple pivot hinge provided by attaching suitable horizontally bored metal support blocks 120 and 122 to the cross plates 60 and 62 and then connecting the arms 116 and 118 to these hinge support blocks 120 and 122 by inserting dowels 124 and 126 in the bores in both the hinge support blocks and through the distal end region of the arms 116 and 118.

The folding of the container is achieved when the end wall 20 and 22 are simultaneously angularly displaced about the hinges 80 and 82 while the hinged slides 100 and 102 attached to these end walls are moved towards one another along the channel iron slides 92 and 94. This displacement simultaneously folds the end walls 20 and 22 and lowers the attached roof. The unfolding of a folded container is achieved by moving the hinged slides away one another along the channel iron slides so as to move or angularly displace the end walls 20 and 22 away from the floor and into vertical positions while simultaneously raising the attached roof.

Stabilizing means may be used during the folding and unfolding of the container to assure that the end walls and the attached roof are substantially uniformly displaced toward and away from the base and thereby minimizing any binding or adverse loadings on the hinges or moving components. Satisfactory stabilization for such purposes may be achieved by affixing a scissoring assembly (not shown) at horizontally spaced apart locations on each of the vertical flanges of the roof framework sections 42 and 44 and to each of the vertical flanges of the floor railings 24 and 26. The folding and unfolding of this scissoring assembly is concurrent with the vertical displacement of the roof 14 and helps maintain the latter in a substantially horizontal plane parallel to the base 12 so as to help assure the uniform angular displacement of the end walls 20 and 22 and the vertical displacement of the roof 14.

A scissor-like mechanism suitable for such stabilization purposes is generally shown in FIGS. 1-4 and more specifically in FIG. 12. This stabilizing mechanism comprises an elongated metal bar 127 movably affixed at the opposite ends thereof to each of the four vertical columns 52, 54, 56 and 58 and to the roof framework section 42 an 44. As shown, the metal bars 127 are attached in a pivotal manner at one end thereof to the side-facings flanges of the vertical columns at common locations at essentially the midpoint thereof by capped pins or bolts 129. The opposite ends of the metal bars are similarly attached to the vertical flanges of the roof framework sections near the end thereof by capped pins or bolts 128. As shown the metal bars 127 are so attached to the roof framework that they lie in a plane parallel to the vertical column when the container 10 is unfolded. The attachments of each of the bars 127 to each of the vertical columns and the roof framework define axes about which the bars 127 can pivot or rotate during the simultaneous displacement of the end walls 20 and 22 and the roof 40 that occurs during the folding and unfolding of the container. As each bar 127 is pivoted it provides and maintains a structural coupling between the end walls 20 and 22 and the roof 14 to assure that the roof 14 is maintained in a plane parallel to the base 12 during the vertical displacements thereof and that the ends walls and the attached roof will be uniformly displaced during container folding and unfolding operations. The stabilizing bars effectively negate or at least substantially minimize any binding at the hinges or couplings. Also, the effective length of each bar 127 is about one-half of the vertical height of each column 52, 54, 56 and 58 to assure that when the container is folded as in FIGS. 10 and 11 the bar will be readily oriented in a horizontal plane parallel to the folded columns without binding or hanging up.

In the present invention the angular displacement of the end walls 20 and 22 in either the container folding or unfolding sequence is achieved with the assistance of a crane, hoist or other suitable lifting mechanism attached to the roof 14. The roof 14 is shown provided with swiveling shackles 130 and 132 connected to the outer side flanges 42 and 44 of the roof framework 40 at a location intermediate the end walls 20 and 22. These shackles 130 and 132 can be welded to the framework 40 as integral fixtures or have the base of the shackles welded to the frame work and the rings of the shackles attached to the fixed base thereof by a suitable fixed or removable pin arrangement as is well known in the use of shackles in lifting applications. A suitable sling such as illustratively shown at 134 in FIG. 4 can be used to couple the shackles 130 and 132 to the supporting and lifting mechanism used for folding or unfolding the container of the present invention. Also, the cross member 49 of the roof framework 40 provides structural support for the roof 14 at the shackle location so that the roof can be supported while being lowered or raised by the crane or other lifting mechanism without binding. It will appear clear that coupling means other than shackles can be placed at various locations on the roof 14 for providing a satisfactory connection with the roof lifting mechanism without departing from the spirit and scope of the present invention.

In a typical container folding operation, the side wall panel fastening devices 78 are removed or released. The side walls 16 and 18 are then sequentially folded about the hinges 72 and 74 into stacked parallel positions overlying the floor deck (FIG. 3). A suitable roof lifting mechanism such as a crane is hooked to the shackles 130 and 132 and then the weight of the roof 14 is sufficiently supported by the lifting mechanism so that tops of the end walls 20 and 22 can be tilted or moved slightly inwardly to provide an initial displacement of the movable hinged slides 100 and 102 along the slides 92 and 94. This initial inward movement of the end walls 20 and 22 can be easily achieved by simply pushing inwardly at the tops of the end walls 20 and 22 when the weight of the roof 14 is substantially removed from the end walls. After this angular inward displacement of the end walls 20 and 22 is initiated, the roof lifting mechanism then steadily lowers the roof so that the weight of the roof bears on the tilted end walls 20 and 22 and angularly displaces them about the hinges 80 and 82 while inwardly moving the movable hinged slides 100 and 102 along the tracks or slides 92 and 94. The roof is continually lowered by the lifting mechanism until the end walls 20 and 22 are positioned end-to-end in locations overlying and parallel with the previously folded side walls 16 and 18 and the eave 38 encompasses the folded walls (FIGS. 10 and 11). With the container 10 so folded a compact substantially weather tight and easily transportable container package is provided.

The unfolding of the folded container is accomplished by reversing the aforedescribed container folding steps in that the lifting mechanism is attached to the roof 14 shackles 130 and 132 and then a lifting force is steadily applied to lift the roof while causing the end walls 20 and 22 to pivot about the hinges 80 and 82 as the movable hinges 100 and 102 travel away from one another along slides 92 and 94. The roof 14 is steadily raised until the end walls are angularly displaced into the desired vertical orientation required of an unfolded container and with end wall 20 being positioned in an abutting relationship with the vertical flange of the floor railing 28. With the end walls so positioned the lifting mechanism is uncoupled to allow the full weight of the roof to bear on the end walls 20 and 22. The side walls 16 and 18 are then manually pivoted into place adjacent to the flanges of the vertical columns of the end wall 20 and 22 and the fasteners 78 are then engaged to secure the side walls 16 and 18 to the roof and the end walls 20 and 22. The resulting container has sufficient structural integrity and is sufficiently weather tight to be satisfactorily used in the envisioned applications such as described above.

What is claimed is:

1. A foldable container comprising elongate base means, elongate roof means oriented in a plane substantially parallel to and vertically spaced from said base means, first and second elongate opposing and vertically oriented side wall means disposed between said base means and said roof means, first and second elongate vertically oriented and opposing end wall means disposed between said base means and said roof means and oriented in vertical planes substantially normal to said first and second side wall means, hinge means connecting an end section of each of the first and the second side wall means to said base means for the pivotable displacement of the first side wall means and the second side wall means towards said base means and into locations adjacent to and overlying the base means during container folding, further hinge means connecting an end section of each of the first and second end wall means to said base means for providing rotational axes for the angular displacement of the first and second end wall means in a first direction towards one another during container folding, elongate slide means attached to said roof means and disposed between the first and second end wall means, and movable hinge means supported by said slide means and connected to an upper surface region of each of the first and second end wall means, said movable hinge means being displaceable along said slide means for the simultaneous vertical displacement of the attached roof and angular displacement of the first and second end wall means in said first direction towards said base means into substantially parallel locations overlying and adjacent to the first and second side wall means and in a second direction opposite to said first direction for the simultaneous angular displacement of the first and second end wall means away from one another and from said substantially parallel location overlying said base means for positioning the first and second end wall means in said vertical orientation and the attached roof means in said plane vertically spaced from the base means.

2. A foldable container as claimed in claim 1, wherein each of said first and second end wall means include frame means disposed at peripheral edge regions thereof with first and second portions of said frame means located adjacent to said first and second side wall means and extending between said base means and said roof means for supporting said roof means, wherein a third portion of said frame means is located adjacent to the roof means and extends between the first and second portions of the frame means and defines said upper surface region of the first and second end wall means, and wherein said further hinge means connect a lower end region of each of the first and second portions of said frame means to the base means.

3. A foldable container as claimed in claim 2, wherein said roof means has framework means disposed at peripheral edge regions thereof, wherein the elongate slide means are attached to said framework means on the roof means and extend thereon substantially between the first and second end wall means.

4. A foldable container as claimed in claim 3, wherein the framework means includes first and second elongated side sections substantially overlying upper end regions of the first and second side wall means and with portions of said side sections being inwardly spaced therefrom, wherein the elongated side sections extend substantially between the first and second end wall means, and wherein the elongate slide means are attached to said portions of each of the first and second elongated side sections.

5. A foldable container as claimed in claim 3, wherein said roof means has framework means disposed at peripheral edge regions thereof and includes elongated side sections substantially overlying upper end regions of the first and second side wall means, wherein the elongate slide means comprises an elongated substantially u-shaped open-sided channel member attached to each of the elongated side sections of the framework means at locations thereon inwardly from said first and second side wall means and extending substantially between the first and second end wall means, wherein said movable hinge means are carried by each said u-shaped channel member, and wherein each said u-shaped channel member has reentrant wall portions at the opening thereinto for supporting and providing a bearing surface for the movable hinge means.

6. A foldable container as claimed in claim 3, wherein said base means includes further upright flange means disposed at a location substantially parallel to and inwardly spaced from one of said first and second end wall means with upper end regions on said further flange means substantially underlying and inwardly spaced from said one of the first and second end wall means, wherein said further upright flange means abuts against said end section of said one of the first and second end wall means when the latter are vertically oriented, and wherein angular displacement of the frame means relative to the base means provides for the positioning of said one of the first and second end wall means at a location overlying the upper end regions of the further upright flange means when said first and second end wall means are in said substantially parallel locations.

7. A foldable container as claimed in claim 3, wherein the first and second end wall means comprises at least one end panel means attached at peripheral edge regions thereof to the frame means of each of the first and second end wall means, wherein the first and second side wall means comprise at least one side panel means having peripheral edge regions disposed contiguous to each said base means said roof means and said frame means of the first and second end wall means, and wherein selectively actuatable fastening means attach the at least one side panel means to the roof means and to the frame means of each of the first and second end wall means.

8. A foldable container as claimed in claim 3, including stabilizing means for maintaining the roof means in a plane substantially parallel with said base means during the displacement of the roof means.

9. A foldable container as claimed in claim 3, wherein roof means are vertically displaceable towards said base means for angularly displacing the first and second end wall means in the first opposing directions and away from said base means for angularly displacing the first and second end wall means in the second opposing directions.

* * * * *